US005390454A

United States Patent [19]

Coddens

[11] Patent Number: 5,390,454

[45] Date of Patent: Feb. 21, 1995

[54] INTERIOR WINDOW ASSEMBLY

[75] Inventor: Donald L. Coddens, South Bend, Ind.

[73] Assignee: Therm-O-Lite, Inc., South Bend, Ind.

[21] Appl. No.: 23,599

[22] Filed: Feb. 26, 1993

[51] Int. Cl.[6] ..... E06B 3/00; E06B 9/38

[52] U.S. Cl. ..... 52/208; 52/202; 49/463; 160/34; 160/107

[58] Field of Search ..... 52/202, 203, 208; 49/61, 62, 63, 414, 419, 463; 160/107, 34, 369

[56] References Cited

U.S. PATENT DOCUMENTS

| | | | |
|---|---|---|---|
| 1,111,621 | 9/1914 | Singer | 49/61 X |
| 2,252,505 | 8/1941 | Harris . | |
| 2,321,554 | 6/1943 | Milnor | 160/107 |
| 2,976,583 | 3/1961 | McCarthy . | |
| 3,080,023 | 3/1963 | Armstrong | 49/419 |
| 3,318,360 | 5/1967 | Persson | 160/107 |
| 4,079,558 | 3/1978 | Gorham . | |
| 4,160,348 | 7/1979 | Chapman | 52/202 |
| 4,223,481 | 9/1980 | Page | 49/63 |
| 4,369,828 | 1/1983 | Tatro . | |
| 4,409,758 | 10/1983 | Dickerson et al. . | |
| 4,450,091 | 6/1984 | Mitchell | 49/62 X |
| 4,452,020 | 6/1984 | Werner | 49/62 X |
| 4,478,002 | 10/1984 | English | 49/62 X |
| 4,561,223 | 12/1985 | Gold et al. . | |
| 4,562,666 | 1/1986 | Young | 49/62 |
| 4,611,648 | 9/1986 | Anderson . | |
| 4,676,024 | 6/1987 | Rossman | 49/62 |
| 4,733,510 | 3/1988 | Werner | 52/202 |
| 5,000,242 | 3/1991 | Coddens | 160/107 |
| 5,226,466 | 7/1993 | Coddens | 52/202 X |
| 5,282,504 | 2/1994 | Anderson et al. | 160/107 |

FOREIGN PATENT DOCUMENTS

| | | | |
|---|---|---|---|
| 1025833 | 4/1966 | United Kingdom | 49/419 |

OTHER PUBLICATIONS

Advertising Literature, "Introducing . . . Sears Window Systems" Why Replace When You Can Insulate?

Therm-O-Lite, Inc. Brochure, "Interior Insulating Window and Patio Door Systems".

Therm-O-Lite Literature, "Finally. Patio door insulation that doesn't seal you in."

Therm-O-Lite Literature ®, "Therm-O-Lite A beautiful way to save".

*Primary Examiner*—Carl D. Friedman
*Assistant Examiner*—Robert J. Canfield
*Attorney, Agent, or Firm*—Barnes & Thornburg

[57] ABSTRACT

An interior insulative window is provided which is mounted outside of the prime window opening to the window opening frame and/or adjacent wall surface. This interior window is internally formed with decorative trim off-site and installed as a single unit which does not penetrate the window opening. The mounting frame can optionally include mounting space for receiving a venetian blind to be retained between the prime window and the interior window. For decorative consistency and/or further thermal efficiency, the corresponding structure can be applied to sliding patio doors.

4 Claims, 2 Drawing Sheets

INTERIOR WINDOW ASSEMBLY

BACKGROUND AND SUMMARY OF THE INVENTION

The present invention relates generally to door and window arrangements for use in buildings and other static structures. More particularly, this invention relates to insulative interior window assemblies that can be installed onto pre existing exterior window assemblies.

Prior to the present increased concern over energy efficiency and cost savings in building maintenance, many buildings, both residential and commercial, were construed with only a single prime or exterior window assembly in the window openings. Further, these window assemblies were often arranged to substantially fill the window opening, leaving little or no room for venetian blinds or shades to be mounted within the window opening. Also, such prior exterior window assemblies often included window panes that were movable in a non vertical direction, such as with awning or casement windows.

In the present time, in order to decrease thermal loses through the window openings and thereby increase the desirability and livability of these older buildings, it has been suggested to employ either interior or exterior storm windows. Exterior storm windows are typically mounted on the outside of the building at the peripheral facing of the window opening to cover the prime window assembly and shield it from the environment. Such arrangements have served to provide improved insulation, but are also subject to certain drawbacks.

To avoid accumulation of condensation between the exterior storm window and the prime window, weep holes or gaps leading from the exterior environment into the space between these windows are typically provided. Thus, an air tight seal is not formed around the exterior storm window to maximize the insulative potential. Further, such storm windows are usually constructed of rigid, weather resistant materials, such as aluminum or other metals. These materials have relatively high thermal conductivity and, as a result, do not permit maximum energy efficiency. Also, exterior storm windows can be difficult to install and require expensive, professional installation, especially where ground plantings surround the window opening and/or at higher window elevations. In some commercial buildings the window elevations are so extreme that exterior storm windows are not available at all as a practical matter. With certain historic buildings and condominium dwellings, use of exterior storm windows is prohibited by law or restrictive covenant. Even when such storm windows can be readily installed, to apply them over casement or awning windows typically severally restricts or entirely eliminates the workability of those prime windows. Also, the workability of the vertically oriented double hung window panes of typical exterior storm windows is adversely affected by the "free fall" mounting often employed for those panes.

So called "interior storm windows" are typically mounted inside the building within the window opening. Such storm windows have, for example, been held in place by magnetic strips or guide tracks secured to the window opening frame directly adjacent the prime window. Interior storm windows can be employed at all building elevations and are substantially unnoticeable from the building exterior, thus overcoming many of the limitations on usage of exterior storm windows. Further, not needing to be as weather resistant, interior storm windows can be constructed of materials which are less thermally conductive.

However, interior storm windows typically require careful, on site measurement of each window and largely custom construction often with professional assistance. Finish trim often needs to be cut and stained at the site and installed separately from the storm window. Further, interior storm windows often interfere with window hardware, such as handles and cranks for casement or awning windows. Thus, the hardware must be removed and those prime windows rendered inoperative if the interior storm window is to be installed. Likewise, since the interior storm window is mounted within the window opening, its mounting frame and panes restrict access to the prime window for cleaning and/or removal of prime window panes. Similarly, in window openings of lesser depth, use of interior storm windows can preclude use of a venetian blind or shade between the prime and storm windows. Such between window mountings of blinds would otherwise be desirable to decrease the accumulation of dust on the blinds.

Accordingly, it is an object of the present invention to provide an improved interior mounted, insulative window assembly. Other objects include the provision of interior window assembly:

1. having low construction and installation costs,
2. which does not restrict prime window operation, particularly for casement and/or awning windows,
3. permitting high thermal efficiency and having reduced through-window heat loss,
4. which allows complete access to the prime window for cleaning or pane removal,
5. which can be prefabricated as an attractive, integral unit with decorative trim,
6. permitting between window mounting of venetian blinds or shades.

These and other objects of the present invention are attained by an interior insulative window mounted outside of the prime window opening to the window opening frame and/or adjacent wall surface. This interior window is internally formed with decorative trim offsite and installed as a single unit which does not penetrate the window opening. The mounting frame can optionally include mounting space for receiving a venetian blind to be retained between the prime window and the interior window. For decorative consistency and/or further thermal efficiency, the corresponding structure can be applied to sliding patio doors.

Other objects, advantages and novel features of the present invention will further become readily apparent from the drawings and detailed description below.

DETAILED DESCRIPTION OF PREFERRED EMBODIMENTS

Figure 1:
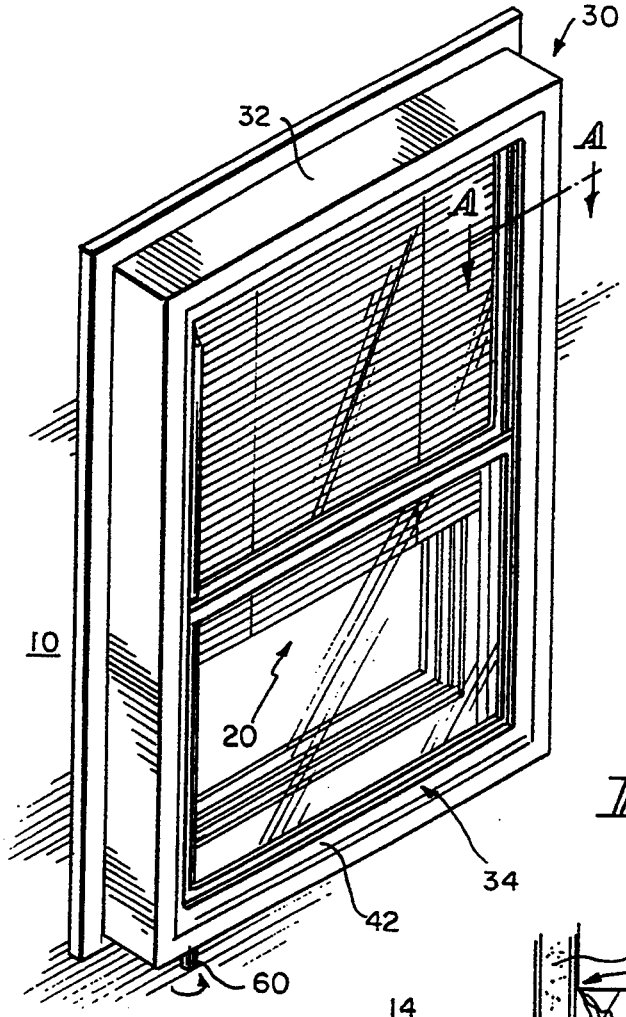
FIG. 1 shows a perspective, plan view of a window arrangement on an interior building wall wherein the present invention is employed.

FIG. 1, which illustrates a preferred embodiment of the present invention, shows an interior wall 10 of a building having a window opening 20 about which interior, insulative window assembly 30 is mounted. Wall 10 is, for example, formed from plaster or sheet rock 12 mounted over a framework of wood beams, such as what are commonly referred to as "2×4s". Where window openings 20 are desired in wall 10, a supporting underlying frame 14 of wood is often provided to define the window opening.

Prime window assembly 22 is typically mounted within window opening 20. This prime window assembly provides the exterior window or barrier against weather penetration of the window opening. Prime window assembly 22 can be of a variety of desired types, including double hung, casement, or awning style. The depth, D, of window opening 20 is generally determined by the desired thickness of wall 10. The thickness of prime window assembly 22 is determined by its framework 24 and hardware (not shown) for the prime window panes 26, but is usually less than depth D such that prime window assembly 22 is entirely retained within window opening 20. If the depth of window opening 20 is large enough, a venetian blind on shade 28 is often mounted within the window opening along with prime window assembly 22.

With the present invention, interior window assembly 30 is mounted to wall 10 without penetrating window opening 20. In that regard the present invention serves as an insulating "overshoe" or overlayment for the pre existing window arrangement. This invention can be included with newly built structures, but is particularly suited for retrofitting into older buildings. Window assembly 30 includes peripheral framework 32, pane supporting peripheral track 34, recess 36 in framework 32 for receiving track 34, and one or more window pane portions 38 mountable in track 34.

Figure 2:
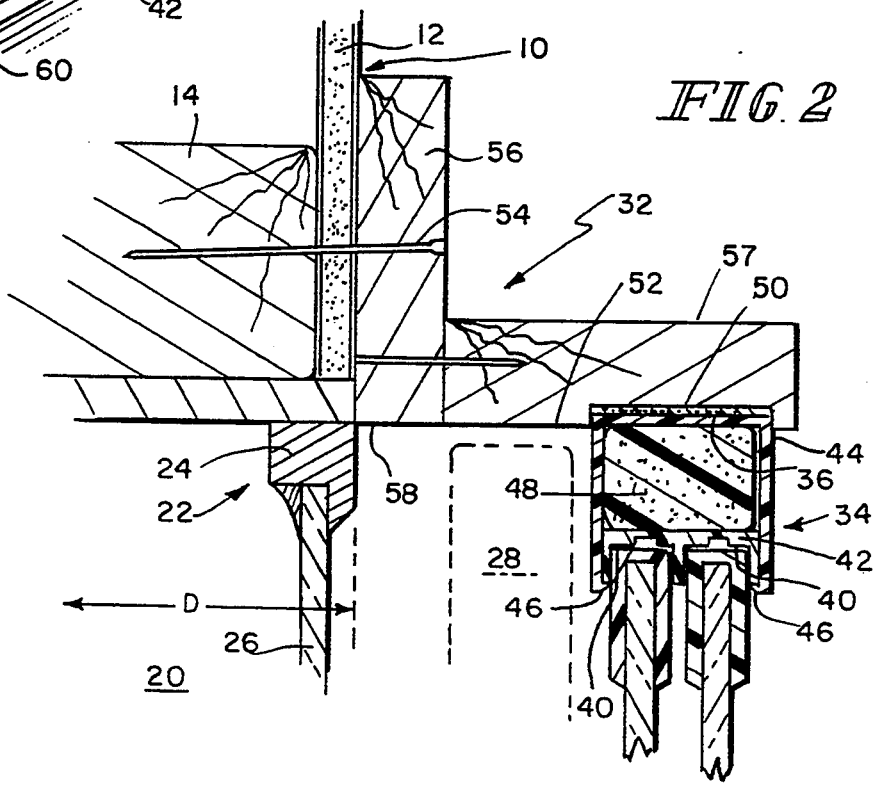
FIG. 2 shows a cross sectional view, along lines A—A of FIG. 1, of a portion of an interior storm window assembly as mounted about the pre existing window opening.
Figure 3:
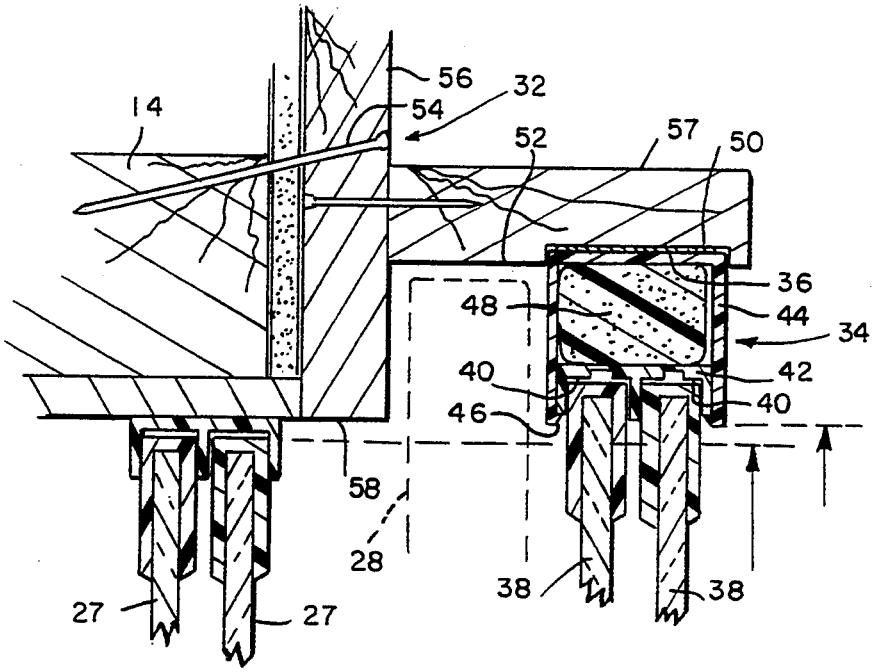
FIG. 3 shows a view, corresponding to FIG. 2, of an alternative embodiment of the present invention.
Figure 4:
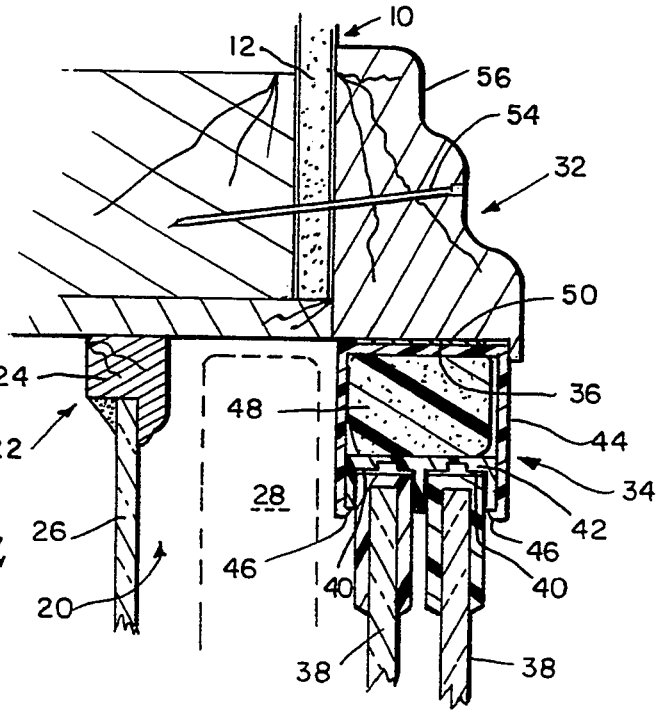
FIG. 4 shows a view, corresponding to FIG. 2, of another alternative embodiment of the present invention.

Preferably, a plurality of pane portions 38 are mounted in track 34 in a double hung arrangement. Thus, track 34 is shown in FIGS. 2–4 as having two pane channels 40 for receiving pane portions 38. Pane channels 40 are, for example, both included in a single formed or extruded element 42 which is mounted within an encompassing C-channel 44. Lips 46 are provided on the open arms of C-channel 44 to removably retain element 42 within the C-channel. Between the bight portions of element 42 and the bight portion of C-channel 44, along the sides of window assembly 30, a tensioning element 48 is preferably provided to urge element 42 into engagement with lips 46.

Tensioning element 48 can be a compressible foam strip, as shown in the figures, a flat metal spring or another device for permitting element 42 to be movable within C-channel 44 at the sides of window assembly 30, although normally biased against lips 46. On the other hand, at the top and bottom of window assembly 30 it is preferable that element 42 remain fixed within C-channel 44, such as by gluing or riveting. Thus, at the top and bottom of window assembly 30 tensioning element 48 can be omitted. On the sides of track 34, tensioning element 48 causes element 42 to apply pressure to pane portions 38 to reduce the free fall effect in manipulating pane portions 38 between open and closed positions.

Track 34 preferably extends about the entire interior perimeter of framework 32 within recess 36 to entirely surround pane portions 38. Track 34 is, for example, secured within recess 36 by adhesive foam tape 50. Recess 36 permits tape 50 to remain concealed after assembly and installation.

Framework 32 is preferably formed from wood. This framework serves both to secure track 34 in a particular spaced relation with respect to the window opening and to provide a desired decorative trim to the finished interior window assembly. In the embodiments of FIGS. 2 and 3, framework 32 further provides a mounting location 52 for venetian blind or shade 28 between the prime window and pane portions 38 of the interior window assembly. Framework 32 can be formed from one or more pieces of wood for each of its sides, top and bottom and is preferably stained and finished prior to installation.

Framework 32 is, for example, mounted to walls 10 by nails or screws 54 which penetrate an outer ledge 56 of framework 32 as well as sheet rock 12 and frame 14. Framework 32 is preferably dimensioned so that its interior wall 58 will be at least as wide and at least as high as the respective width and height of window opening 20. Prior to mounting framework 32, any undesirable pre existing window trim can be removed from the area of wall 10 around window opening 20. Alternatively, framework 32 can be dimensioned to be mountable over any existing trim. If a window sill is present, it can be removed before installing framework 32 or framework 32 can be notched or cut to fit over or around that sill, according to the decor desired at a particular site. Similarly, if framework 32 is to be installed over a sliding or patio door, any undesired portion of framework 32, such as ledge 56, along the bottom of framework 32 can be removed. In most other aspects, the sides, top and bottom of framework 32 are substantially uniform in construction and appearance.

Window assembly 30 is preferably prefabricated as an integral unit in certain standard sizes so as to be readily mounted over window opening 20 as a finished product. By not penetrating the window opening, the present invention avoids interfering with pre existing window hardware. By not being dimensionally smaller than the window opening certain embodiments of the present invention avoid interfering with cleaning and/or removal of window panes 26 of the prime window.

Comparing the different embodiments of FIGS. 2–4, FIG. 2 shows use of the present invention where little or no usable depth remains on the interior side of the window opening after installation of prime window 22. Prior to the present invention, if a venetian blind was desired it would have to be mounted to the window trim (often having only an irregular, decorative surface available for blind mounting) or beyond the window trim directly onto wall 10. With the present invention, blind 28 can be secured to return area or mounting location 52 outside of window opening 20, but still between the glass of panes 26 and pane portions 38. Thus, blind 28 is more isolated from dust and needs less cleaning. Access to control rod 60 (or whatever tilt cords or adjustment mechanism used by a given blind or shade) is obtained by drilling an aperture into the bottom of framework 32 wherever desired.

FIG. 3 shows use of the present invention where little or no usable depth remains on the interior side of the window opening and where prime window 22 employs removable, double hung panes 27. Upstanding portion 57 of framework 32 is spaced back from interior wall 58 a sufficient distance to accommodate track 34 and the mounting bracket (not shown) for blind 28 without restricting removal of panes 27 passing through window assembly 30 to the building interior. This embodiment of the present invention is also particularly useful in accommodating tilt windows whose operation requires manipulation of window panes out of window opening 20 toward the building interior.

FIG. 4 shows use of the present invention where sufficient depth remains on the interior side of the window opening to mount blind 28 therein, but undesirable spacing exists on the sides, top and/or bottom of blind 28 and/or mounting bracket which lets excess light into the building. In such situations, window assembly 30, for example, is mounted outside of window opening 20 and includes a portion thereof, such as track 34, which overlaps window opening to the extent necessary to cover that undesirable spacing. This figure also illustrates an exemplary decorative molding incorporated into framework 32.

In especially preferred embodiments track 34 is formed from material having low thermal conductivity, such as vinyl plastic. Prefabricated assembly in a factory further decreases production costs of window assembly 30 and increases attractiveness because of precision joints and uniform finishing.

Although preferred embodiments of the present invention have been described above in detail, that description is only by way of illustration and example and is not to be considered as limiting the scope of the invention. Those of ordinary skill in the art will now readily recognize that various modifications to the embodiments described above can be made without departing from the spirit and scope of this invention. Accordingly, the present invention is limited only by the terms of the claims appended hereto.

What is claimed is:

1. A window arrangement in a building comprising:
a wall portion for supporting said window arrangement within said building;
a window opening within said wall portion;
an exterior window mounted within said window opening;
an interior frame portion mounted to said wall portion without penetrating said window opening;
an interior window mounted to said interior frame portion without penetrating said opening;
a window blind mounted within said window opening between said exterior window and said interior window; and
wherein said interior frame portion includes a part thereof which covers a part of said window opening to overlap the edges of said window blind.

2. The window arrangement according to claim 1, wherein said interior frame portion includes a first segment which is secured to said wall portion, said interior window including a support track assembly about its perimeter, and said first segment including a recessed region for receiving a portion of said support track assembly.

3. The window arrangement according to claim 2 wherein said support track assembly includes a divided channel element for separately receiving a plurality of interior window panes, and a means for establishing an insulating seal between said channel element and said recessed region.

4. The window assembly according to claim 2, wherein said interior window is removably attached to said interior frame portion.

* * * * *